US006648025B2

(12) United States Patent
Smith et al.

(10) Patent No.: US 6,648,025 B2
(45) Date of Patent: Nov. 18, 2003

(54) BEVERAGE DISPENSE

(75) Inventors: Stephen Paul Smith, Derbyshire (GB); Stuart William Molzahn, Derbyshire (GB)

(73) Assignee: Coors Worldwide Inc., Golden, CO (US)

( * ) Notice: Subject to any disclaimer, the term of this patent is extended or adjusted under 35 U.S.C. 154(b) by 0 days.

(21) Appl. No.: 10/123,385

(22) Filed: Apr. 16, 2002

(65) Prior Publication Data

US 2003/0192615 A1 Oct. 16, 2003

(51) Int. Cl.[7] ..... B65B 1/04

(52) U.S. Cl. ..... 141/2; 147/174; 147/173; 147/275; 147/9; 147/351

(58) Field of Search ..... 141/174, 173, 141/9, 18, 2, 250, 268, 270, 275, 281, 351, 360, 361, 362

(56) References Cited

U.S. PATENT DOCUMENTS 2,757,846 A * 8/1956 Varrin ..... 222/250
3,105,526 A * 10/1963 Hurtig ..... 141/171
4,026,335 A * 5/1977 Willemsen ..... 141/250
4,159,028 A * 6/1979 Barker et al. ..... 141/9
4,966,205 A * 10/1990 Tanaka ..... 141/9
4,974,643 A * 12/1990 Bennett et al. ..... 141/360
5,086,817 A * 2/1992 Murphy ..... 141/271
5,095,955 A * 3/1992 Barnewitz et al. ..... 141/270
5,791,385 A * 8/1998 Stahlecker ..... 141/270
6,298,638 B1 * 10/2001 Bettle ..... 53/452

FOREIGN PATENT DOCUMENTS

GB 2367810 A * 4/2002

* cited by examiner

*Primary Examiner*—Gregory L. Huson
*Assistant Examiner*—Khoa Huynh
(74) *Attorney, Agent, or Firm*—Schiff Hardin & Waite

(57) ABSTRACT

Apparatus for dispensing beverage, such as beer, which forms a head, comprises a rotatable table on which a drinking vessel is supported, and a nozzle which is arranged to direct a stream of beverage against the side of the vessel as it rotates. This provides good control over the size of the head produced. Various parameters, such as the temperature of the beverage can be monitored during the dispense, and the apparatus controlled, by adjusting the rate of rotation of the table, the rate of dispense of the beverage, or the angle at which the beverage impacts the side of the vessel, so as to produce a desired amount of head on the dispensed beverage.

46 Claims, 4 Drawing Sheets

BEVERAGE DISPENSE

FIELD OF THE INVENTION

The present invention relates to the dispensing of beverages and in particular to the dispensing of beverages which form a head. It is therefore of particular relevance to the dispense of beer, including lager, ale, porter and stout, but is also relevant to the dispense of other alcoholic and non-alcoholic beverages with a dissolved gas content.

Background to the Invention

There are many types of beverage which form a head when dispensed into a drinking vessel such as a glass, and in many circumstances there is a need to control the size of the head. This can be simply to meet the tastes of the person who will drink the beverage, or it can be to meet legal requirements, in particular where a beverage with a head is being sold by volume in a drinking vessel.

It is known, for example from WO 01/36582, to dispense a beverage into a drinking vessel using a dispensing apparatus in which the vessel is supported on a stand or table, and a predetermined volume of beverage is dispensed into the vessel from a dispense nozzle. However there are various factors which can affect the size of the head on a beverage dispensed in this way. This can be a problem because the amount of head on some beverages sold by volume is controlled by law, and also because the size of head on some beverages is a matter of personal taste and it is therefore desirable to be able to provide the customer with exactly the amount of head he or she prefers

Summary of the Invention

Accordingly the present invention provides a method of dispensing a beverage into a drinking vessel having a base and a side wall, the method comprising the steps of supporting the vessel, rotating the vessel, and directing a stream of the beverage against the side wall of the vessel while the vessel is rotating.

The stream of beverage preferably impacts the side wall of the vessel at an angle of between 20° and 40°, more preferably between 30° and 40°.

The vessel is preferably of circular section, and is preferably rotated about its central axis.

The stream of beverage may be projected from a nozzle in a direction which is inclined to said axis. Alternatively the stream of beverage may be diverted after it is emitted from the nozzle.

Conveniently the vessel may be supported such that the axis is vertical, but it can also be supported so that the axis is inclined to the vertical.

Preferably the vessel is rotated such that its side wall has a direction of rotation, and the stream of beverage is directed such that, when it contacts the side of the vessel, it has a component of travel in said direction of rotation. This can help to smooth the flow of beverage in the vessel and thereby help to control the amount of head produced.

The rate of dispense of the beverage, the rate of rotation of the vessel, and the angle at which the stream of beverage impacts the side of the vessel may each be controlled to control the size of the head, and may also be varied during dispense of the beverage.

The impact angle of the stream of beverage on the side of the vessel may be controlled by controlling, and optionally also by varying, the angle at which the vessel is supported, the angle at which the nozzle is arranged, or the rate at which the beverage is dispensed.

Preferably the dispensing has a plurality of parameters associated with it, and the method comprises monitoring one of the parameters and controlling the dispensing so as to control the size of the head.

The parameter which is monitored may be, for example, the dispense temperature at which the beverage is dispensed, a storage temperature at which the beverage has been stored, for example in a cellar or in a tank below a drinks bar, or an ambient temperature of the environment in which the beverage is dispensed.

The present invention further provides apparatus for dispensing a beverage into a drinking vessel having a base and a side wall, the apparatus comprising a support for supporting the vessel, and a nozzle for dispensing a stream of the beverage into the vessel, wherein the support is arranged to rotate the vessel and the nozzle is arranged to direct said stream against the side wall of the vessel while the vessel is rotating.

Preferably the support defines an axis of rotation about which the vessel can be rotated and the nozzle is arranged to direct said stream in a direction which is inclined to said axis.

Preferably the apparatus is arranged to dispense the beverage into the vessel such that a head forms on the beverage, wherein the apparatus is arranged to control the size of the head.

Preferably the apparatus is arranged so that it can control the size of the head to any of a plurality sizes, and further comprises an operator input arranged to allow an operator to select one of said sizes of the head.

Preferably the apparatus is arranged to dispense the beverage in any of a plurality of volumes and, for at least one of said volumes, the apparatus can control the size of the head to any said plurality of sizes. For example of the apparatus is arranged to dispense the beverage in volumes of one pint or a half pint, each one of these measures may be chosen with any of a plurality of different sizes of head.

Preferably the apparatus further comprises at least one sensor for sensing a value of at least one parameter relating to the dispensing of the beverage, and a controller arranged to adjust the apparatus in response to the value of said at least one parameter to control the size of the head.

The support may be arranged to support the vessel such that its side wall is inclined at an angle with the vertical, and to vary said angle while the beverage is dispensed. Furthermore, said angle may be controlled to control the size of the head formed on the beverage.

Preferred embodiments of the present invention will now be described by way of example only with reference to the accompanying drawings.

DETAILED DESCRIPTION OF THE PREFERRED EMBODIMENTS

Figure 1:
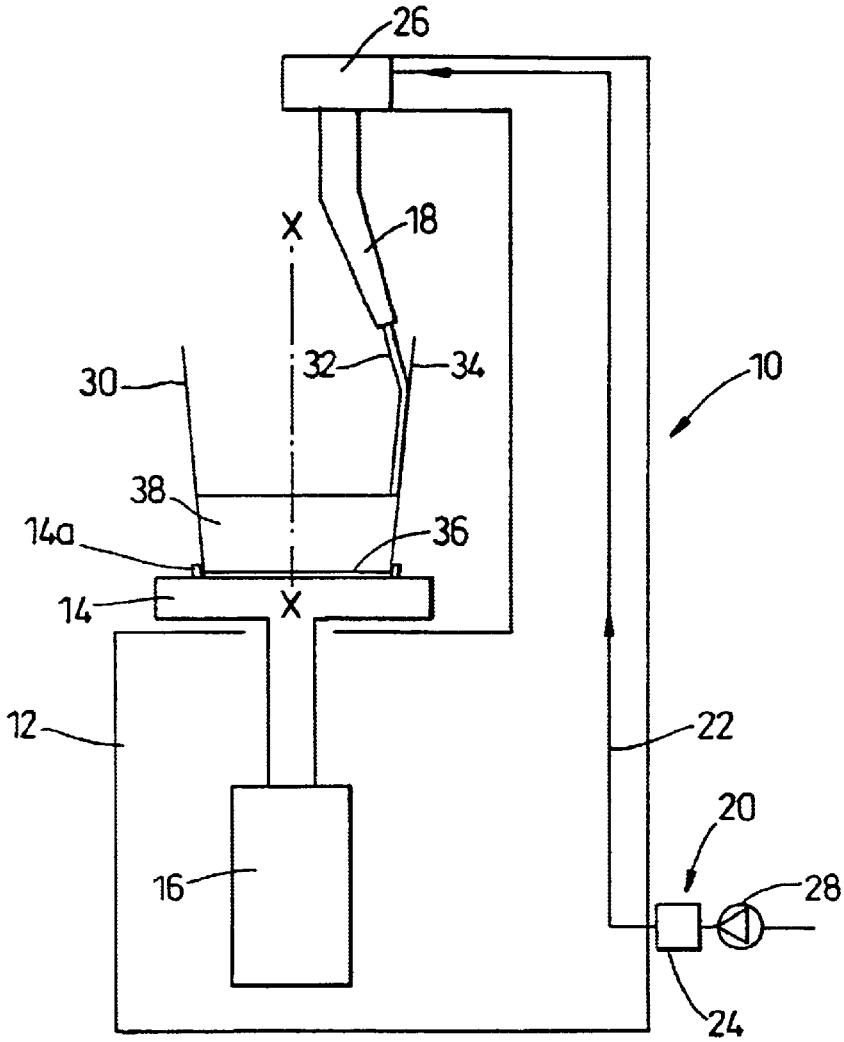
FIG. 1 is a diagrammatic representation of a beverage dispense apparatus according to a first embodiment of the invention.

Referring to FIG. 1, in a first embodiment of the invention, a beverage dispensing apparatus comprises a font 10 arranged to be mounted on a drinks bar. The font 10 comprises a housing 12 and a horizontal table 14 rotatably supported in the housing, a motor 16 for rotating the table, a nozzle 18 for dispensing beverage, and a beverage supply system 20. The beverage supply system 20 comprises a supply pipe 22 a metering device 24, a control valve 26 for diverting beverage from the supply pipe 22 to the nozzle 18, and a pump 28 for pumping the beverage to the nozzle 18 and controlling the pressure of the beverage at the nozzle.

In order to dispense a measure of beverage into a glass 30, the glass, which is of circular cross section, is placed on the table 14, which has an annular lip 14*a* on it to locate the glass in the centre of the table, and the system activated. The motor 16 rotates the table 14 at a constant speed of 45 rpm, which rotates the glass 30 about its central axis X—X which is vertical. The pump 28 pumps beverage towards the valve 26, which opens to dispense the beverage into the glass 30. The beverage is emitted from the nozzle as a continuous stream 32 which impacts the side 34 of the glass 30 and runs down it to the base 36 of the glass. As the glass fills, the beverage 38 in it rotates with the glass and the beverage running down the side 34 of the glass is also carried round with the glass to a limited extent. Therefore when the beverage running down the glass reaches that in the glass, the rotation helps to smooth the flow of the beverage. This helps to reduce the size of the head that will build upon the beverage.

Figure 2:
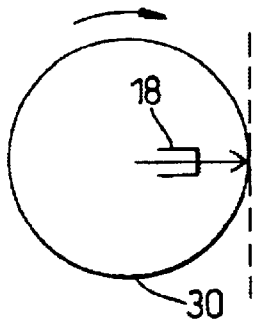
FIG. 2 shows the direction of dispense of the beverage in the apparatus of FIG. 1.

Referring to FIG. 2, the nozzle 18 is arranged such that the stream 32 of beverage is projected in a direction which is radial with respect to the glass 30, but angle downwards. The stream of beverage therefore travels in a radial plane which extends radially from the central axis X—X of the glass 30. Therefore when the stream of beverage impacts on the side of the glass it has components of motion in the radial direction and in the vertical direction, but not in the direction in which the side 34 of the glass is travelling. Therefore any motion in that direction of the beverage running down the side of the glass is imparted to the beverage by the glass.

When the required volume of beverage has been dispensed and the table 14 continues to rotate for a short period of a few seconds, after which the rotation is stopped. The rate of change of the speed of rotation during the stopping of the table affects the amount of head that will result on the finally dispensed beverage. In this embodiment the rotation is stopped rapidly, indeed it is stopped substantially instantaneously. This produces a degree of agitation of the beverage which causes some of the gas dissolved in the beverage to form bubbles and therefore produces a larger head than if the rotation were stopped slowly. It also produces an interesting visual effect as the beverage continues to rotate in the glass after the glass has ceased to rotate, and bubbles of gas entrained in the beverage continue to rotate with it.

In this particular example the beverage is lager and is dispensed into a pint glass through a nozzle of diameter 8 mm in about 20 seconds. The nozzle is at an angle of 40° to the vertical and the lager impacts the side of the glass at an angle of approximately 35°.

In another mode of operation of the system of FIG. 1, the rotation of the table 14, and hence the rotation of the glass 30, is arranged to stop at a predetermined time during dispense of the beverage, i.e. before the end of the dispensing cycle. Because rotation of the glass is used to reduce the build up of a head, stopping the rotation allows a period towards the end of the dispense cycle in which the head can build up more rapidly. The time at which the rotation stops can therefore be a factor in determining the size of head produced.

Figure 3:
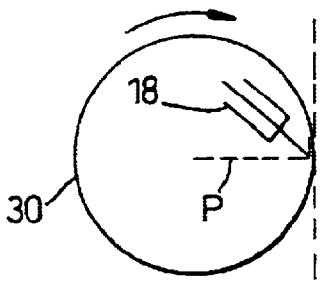
FIG. 3 shows an alternative direction of dispense of beverage.

Referring to FIG. 3, in a modification to the system, the nozzle 18 is inclined to the radial plane P so that when the stream of beverage impacts the side 34 of the glass it has a component of travel in the direction of travel of the side 34 of the glass caused by the rotation of the glass 30. This can further smooth the flow of beverage into the glass and thereby further reduce the head on the dispensed beverage.

Figure 4:
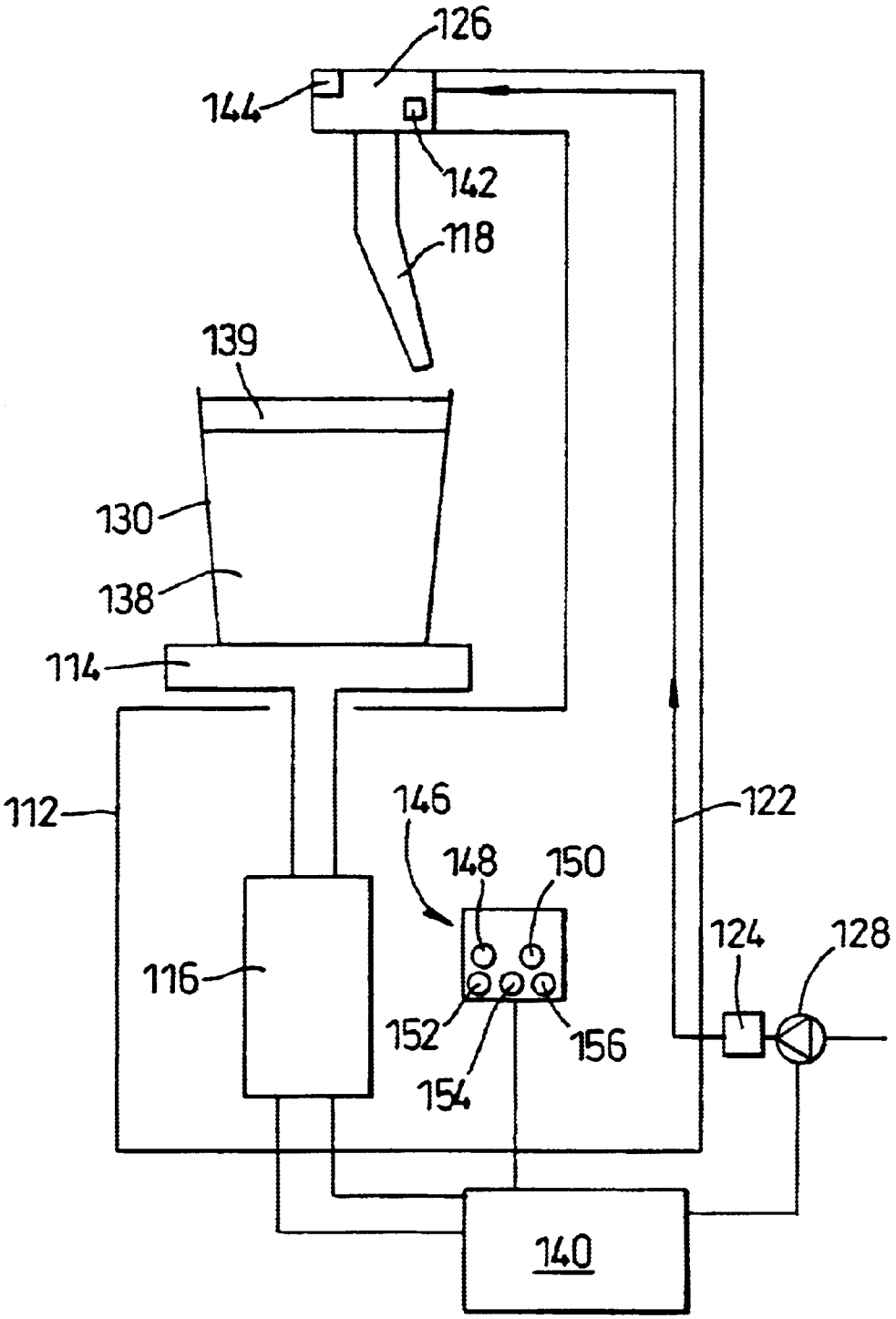
FIG. 4 is a diagrammatic representation of a beverage dispense apparatus according to a second embodiment of the invention.

Referring to FIG. 4, a second embodiment of the invention will now be described. Features corresponding to those in FIG. 1 are given the same reference numeral preceded by a 1. In this embodiment a controller 140 is provided which monitors various parameters of the system and provides a greater degree of control over the dispensing process. Specifically the controller 140 is connected to the pump 128 so that it can control the pressure at which the beverage is dispensed, and to the motor 116 so that it can control the rate at which the table 114 is rotated. It is also connected to a pressure sensor 142 and temperature sensor 144 in the dispense valve 126 so that it can monitor the pressure and temperature at which the beverage is being dispensed. Finally it is also connected to a user input 146 comprising first and second buttons 148, 150 which are operable to select the size of head that will be produced on the dispensed beverage. Since the maximum size of head is determined legally, the selection will generally be between a large head, which is close to the legal maximum, and a smaller head. The user input 146 also comprises three further buttons, one 152 of which is arranged to select a first volume of beverage for dispense, in this case a pint, the second 154 of which is arranged to select a second volume of beverage for dispense, in this case half a pint, and the third 156 of which is a top-up button arranged to allow a user to add small amounts of beverage to the drinking vessel.

There are various parameters of the dispensing operation which will affect the size of the head produced on the dispensed beverage. As the pressure, and hence speed, at which the beverage is dispensed increases, the size of the head will increase, As the temperature of the dispensed beverage increases, the size of the head decreases. As the rate of rotation of the table increases from zero, the size of the head decreases Up to a speed of rotation of about 45 rpm. Thereafter increasing the speed of rotation further increases the size of the head because of the increases agitation of the beverage.

Another factor which will clearly affect the size of head is the type of beverage dispensed. The controller 114 can therefore be set for whichever type of beverage is to be dispensed.

During operation of this system, to dispense a glass of beverage, the glass 130 is placed on the table 114, and one of the buttons 148, 150 pressed to select the size of head the consumer chooses, and one of the volume buttons 152, 154 pressed to select the volume of beverage to be dispensed.

The table is then set to rotate and the valve 126 is opened to dispense the beverage against the side of the glass as it rotates. During the dispense the controller 140 monitors the temperature and pressure of the beverage and varies the speed of rotation of the table 144 so that the head 139 on the fully dispensed beverage 138 is of the size required. The speed of rotation of the table 144 can be varied continuously during the dispense cycle. Alternatively the rotation can be stopped during the dispense cycle to provide a period during which the beverage is being dispensed into the non-rotating glass. The time at which rotation is stopped is variable and can be controlled as required to control the size of the head. Also the rate of change of speed of rotation as the rotation stops is variable and can be controlled, whether it occurs during or after dispense, so as to control the size of head.

It will be appreciated that the size of head can be controlled in various other ways, and on the basis of various inputs. For example the speed of dispense can be varied by controlling the pump 128 or the valve 126. Alternatively the speed of rotation of the table 144 could be taken as an input, for example if it were being controlled for some other reason, as could the ambient temperature of the environment or room in which the beverage is being dispensed, or the temperature at which the beverage has been stored prior to being supplied to the font.

Figure 5:
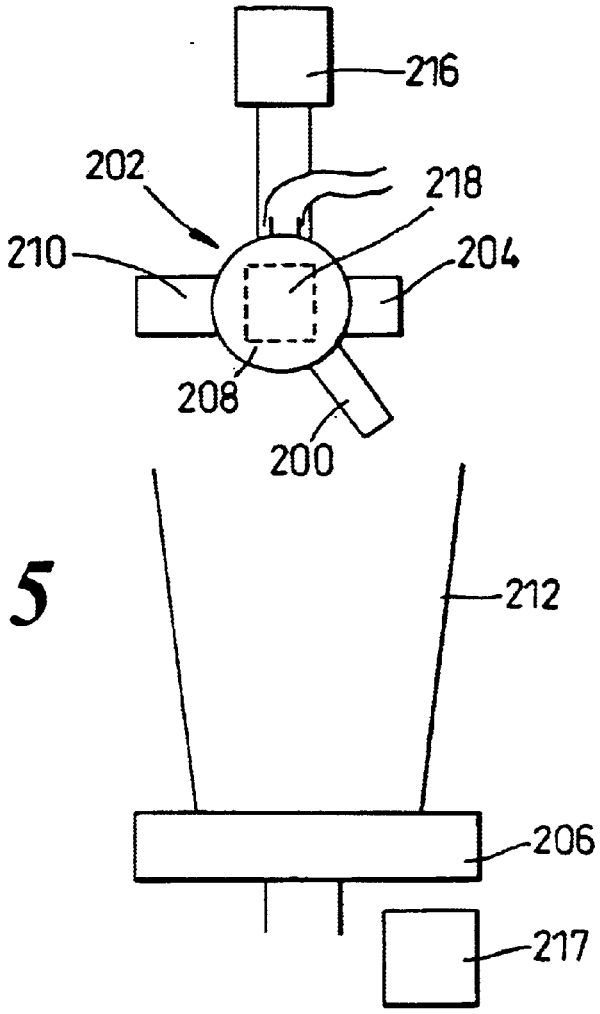
FIG. 5 is a diagrammatic representation of a beverage dispense apparatus according to a third embodiment of the invention.

Referring to FIG. 5, in a third embodiment of the invention the nozzle 200 is mounted by means of a ball and socket joint 202 on a support 204 above the rotatable table 206. The support 202 is movable vertically on the font so as to vary the height of the nozzle 200 above the table 206, and the ball 208 of the ball and socket joint 202 is rotatable in the socket 210 to vary the angle of the nozzle 200.

Figure 6:
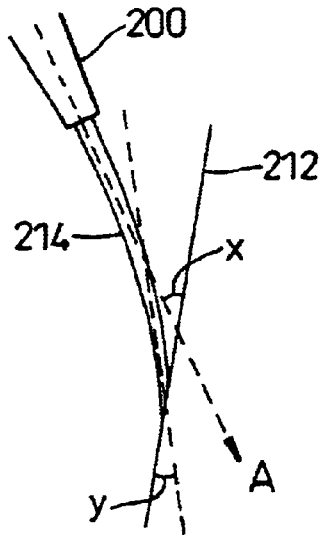
FIG. 6 shows a stream of beverage from the apparatus of Figure impacting a drinking vessel.

Referring to FIG. 6, the nozzle 200 points in the direction of the arrow A which is at an angle x, in this case 40°, to the side of the glass 212 which is supported on the table 206. When a stream of beverage 214 is emitted from the nozzle 200 it does not travel in a straight line, but in a parabolic path, so that the angle y at which it impacts the side of the glass is different from the angle x. In this case the angle y is 30°. The angle x will depend on the orientation of the nozzle and the angle of the side of the glass 212. The angle y will depend on both of those factors and also the height of the nozzle 200, the speed of the stream of beverage, and the distance travelled in the horizontal direction between the nozzle and the glass.

Therefore in this third embodiment the controller 217, as well as being connected to the various components of the system corresponding to those in FIG. 4 to which the controller 140 are connected, is also connected to a first motor 216 for adjusting the height of the support 204 and a second motor 218 for adjusting the angle of the nozzle 200. This allows adjustment of the height of the nozzle 200 above the table 206, and therefore above the glass 212, and also of the angle x at which the beverage is emitted from the nozzle 200, and the impact angle y at which the stream of beverage impacts the side of the glass 212.

Figure 7:
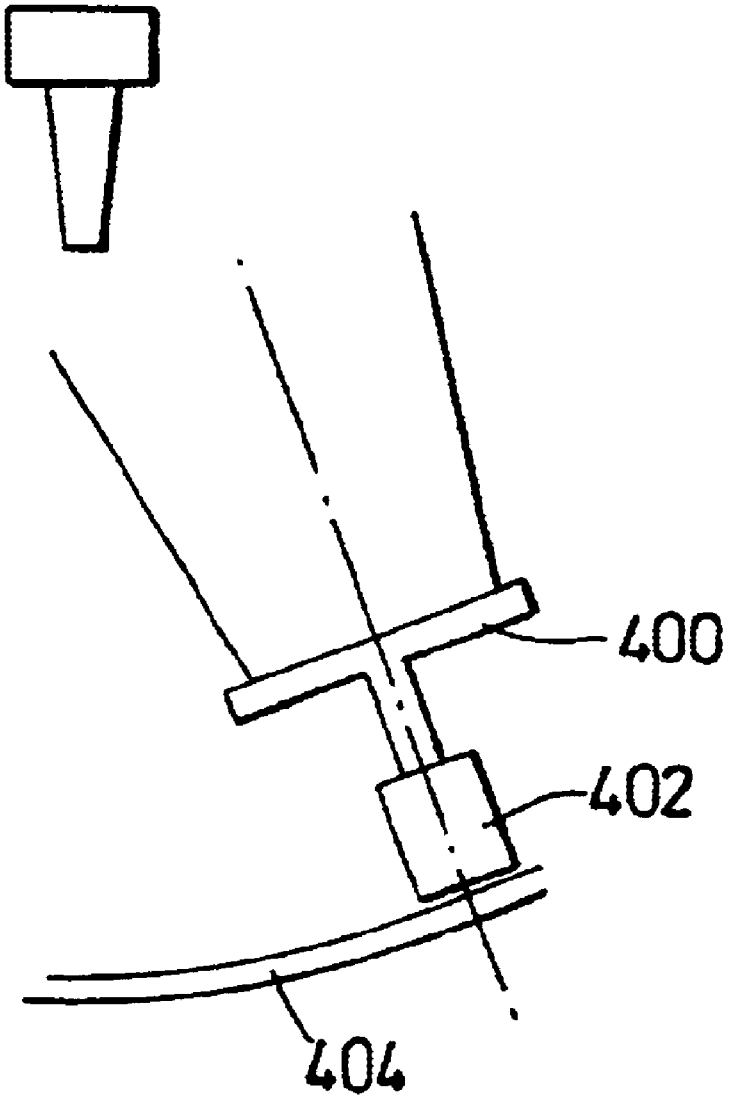
FIG. 7 shows a nozzle of a dispense apparatus according to a fourth embodiment of the invention.

Referring to FIG. 7 in a fourth embodiment a rotatable table 400 and its motor 402 are slidably supported on a curved rail 404 having a bottom end 406 which is substantially horizontal and a top end which is inclined to the horizontal. A nozzle 408 is provided above the rail 404 in a position such that, when the table is at the top of the rail, supporting the glass 410 at an inclined angle, the nozzle will dispense beverage vertically downwards against the side of the glass 410 which is inclined to the vertical. During the dispense the glass rotated on the table and the table is moved down the rail 404 so that, by the end of the dispense cycle, the glass is held vertically upright beneath the nozzle 408. The beverage is therefore only dispensed against the side of the glass 410 for part of the dispense cycle. For the remainder of the cycle it is dispensed into the beverage in the glass.

The apparatus of FIG. 7 can be combined with sensors and a controller similar to those of the apparatus of FIG. 4 with the position, and rate of change of position, and therefore angle and rate of change of angle, of the table 400 being adjustable so as to control the size of head produced on the dispensed beverage.

We claim:

1. A method of dispensing a beverage into a drinking vessel having a base and a side wall and being of circular section, the vessel having a central axis, the method comprising the steps of supporting the vessel, rotating the vessel about the central axis, and directing a stream of the beverage against the side wall of the vessel while the vessel is rotating.

2. The method according to claim 1 wherein the stream of beverage is projected from a nozzle in a direction which is inclined to said axis.

3. The method according to claim 2 wherein the vessel is supported such that the axis is vertical.

4. The method according to claim 1 wherein the vessel is rotated such that its side wall has a direction of rotation, and the stream of beverage is directed such that, when it contacts the side of the vessel, it has a component of travel in said direction of rotation.

5. The method according to claim 1 wherein the beverage is dispensed such that a head is formed on the beverage in the vessel.

6. The method according to claim 5 wherein the beverage is dispensed at a rate which is controlled so as to control the size of the head.

7. The method according to claim 6 wherein said rate is varied during dispense of the beverage.

8. The method according to claim 5 wherein the vessel is rotated at a rate which is controlled so as to control the size of the head.

9. The method according to claim 8 wherein said rate is varied during dispense of the beverage.

10. The method according to claim 8 wherein the rotation is stopped during dispense of the beverage.

11. The method according to claim 5 wherein the beverage is dispensed so that it impacts the side wall of the vessel at an impact angle, and the impact angle is controlled to control the size of the head.

12. The method according to claim 11 wherein the vessel is supported on a support which is arranged at a support angle, and the impact angle is controlled by controlling the support angle.

13. The method according to claim 11 wherein the beverage is dispensed using a nozzle which is arranged at a nozzle angle, and the impact angle is controlled by controlling the nozzle angle.

14. The method according to claim 11 wherein the beverage is dispensed at a dispense rate, and the impact angle is controlled by controlling the dispense rate.

15. The method according to claim 5 wherein the dispensing has a plurality of parameters associated with it, and the method comprises monitoring one of the parameters and controlling the dispensing so as to control the size of the head.

16. The method according to claim 15 wherein the beverage is dispensed at a dispense temperature and said one of the parameters is the dispense temperature.

17. The method according to claim 15 wherein the beverage is stored at a storage temperature and said one of the parameters is the storage temperature.

18. The method according to claim 15 wherein the beverage is dispensed in an environment which is at an ambient temperature and said one of the parameters is the ambient temperature.

19. The method according to claim 1 wherein the side wall of the vessel is inclined at an angle to the vertical while the beverage is dispensed.

20. The method according to claim 19 wherein said angle is varied while the beverage is dispensed.

21. The method according to claim 19 wherein said angle is controlled to control the size of the head formed on the beverage.

22. A beverage dispensing apparatus for dispensing a beverage into a drinking vessel having a base and a side wall and being of circular section, the vessel having a central axis, the apparatus comprising a support for supporting the vessel, and a nozzle for dispensing a stream of the beverage into the vessel, wherein the support is arranged to rotate the vessel about the central axis and the nozzle is arranged to direct said stream. against the side wall of the vessel while the vessel is rotating whereby the beverage will impact the side of the vessel and run down the side of the vessel.

23. The apparatus according to claim 22 wherein the support defines an axis of rotation about which the vessel can be rotated and the nozzle is arranged to direct said stream in a direction which is inclined to said axis.

24. The apparatus according to claim 23 wherein the support is adapted to be used with a vessel having a central axis, and to rotate the vessel about said central axis.

25. The apparatus according to claim 24 wherein the support is arranged to support the vessel such that the central axis is vertical.

26. The apparatus according to claim 23 wherein the support is arranged to rotate the vessel such that its wall has a direction of rotation, and the nozzle is arranged to direct the stream of beverage such that when it impacts on the wall, it has a component of travel in the direction of rotation.

27. The apparatus according to claim 22 which is arranged to dispense the beverage into the vessel such that a head forms on the beverage, wherein the apparatus is arranged to control the size of the head.

28. The apparatus according to claim 27 which is arranged to dispense the beverage at a dispense rate, and the dispense rate is variable to control the size of the head.

29. The apparatus according to claim 28 which is arranged to vary said dispense rate during dispense of the beverage.

30. The apparatus according to claim 27 wherein the support is arranged to rotate the vessel at a rotation rate which is variable to control the size of the head.

31. The apparatus according to claim 30 wherein the support is arranged to vary said rotation rate during dispense of the beverage.

32. The apparatus according to claim 31 wherein the support is arranged to stop rotation of the vessel during dispense of the vessel.

33. The apparatus according to claim 32 wherein the time at which said rotation is stopped is variable.

34. The apparatus according to claim 27 wherein the nozzle is arranged to dispense the beverage so that it impacts the side wall of the vessel at an impact angle, and the impact angle is variable to control the size of the head.

35. The apparatus according to claim 34 wherein the support is arranged at a support angle which is variable to adjust the impact angle.

36. The apparatus according to claim 34 wherein the nozzle is arranged at a nozzle angle which is variable to adjust the impact angle.

37. The apparatus according to claim 34 which is arranged to dispense the beverage at a dispense rate which is variable to adjust the impact angle.

38. The apparatus according to claim 27 which is arranged so that it can control the size of the head to any of a plurality sizes, and which further comprises an operator input arranged to allow an operator to select one of said sizes of the head.

39. The apparatus according to claim 38 which is arranged to dispense the beverage in any of a plurality of volumes and, for at least one of said volumes, the apparatus can control the size of the head to any of said plurality of sizes.

40. The apparatus according to claim 27 further comprising at least one sensor for sensing a value of at least one parameter relating to the dispensing of the beverage, and a controller arranged to control the apparatus in response to the value of said at least one parameter to control the size of the head.

41. The apparatus according to claim 40 wherein said at least one parameter includes a temperature.

42. The apparatus according to claim 41 wherein said temperature is a dispense temperature of the beverage.

43. The apparatus according to claim 41 wherein said temperature is a storage temperature of the beverage.

44. The apparatus according to claim 41 wherein said temperature is an ambient temperature of an environment in which the beverage is dispensed.

45. The apparatus according to claim 22 wherein the support is arranged to support the vessel such that its side wall is inclined at an angle with the vertical, and to vary said angle while the beverage is dispensed.

46. The apparatus according to claim 45 wherein said angle is controlled to control the size of the head formed on the beverage.

* * * * *